US005728665A

United States Patent [19]

Choy et al.

[11] Patent Number: 5,728,665

[45] Date of Patent: Mar. 17, 1998

[54] COMPOSITION AND METHOD FOR DEVELOPING EXTENSIONAL VISCOSITY IN CLEANING COMPOSITIONS

[75] Inventors: Clement Kin-Man Choy, Alamo; Brian Patrick Argo, Tracy, both of Calif.

[73] Assignee: The Clorox Company, Oakland, Calif.

[21] Appl. No.: 527,817

[22] Filed: Sep. 13, 1995

[51] Int. Cl.[6] ..... C11D 1/22; C11D 1/28; C11D 1/75; C11D 3/395

[52] U.S. Cl. ..... 510/373; 510/369; 510/379; 510/380; 510/427; 510/433; 510/503

[58] Field of Search ..... 510/369, 373, 510/379, 380, 427, 433, 503

[56] References Cited

U.S. PATENT DOCUMENTS

| | | | |
|---|---|---|---|
| 3,684,722 | 8/1972 | Hynam et al. | 252/98 |
| 4,071,463 | 1/1978 | Steinhauer | 252/103 |
| 4,229,313 | 10/1980 | Joy | 252/95 |
| 4,282,109 | 8/1981 | Citrone et al. | 252/102 |
| 4,337,163 | 6/1982 | Schlip | 252/96 |
| 4,390,448 | 6/1983 | Boden et al. | 252/187 |
| 4,399,050 | 8/1983 | Bentham et al. | 252/95 |
| 4,538,745 | 9/1985 | Dunning et al. | 222/153 |
| 4,576,728 | 3/1986 | Stoddart | 252/102 |
| 4,646,973 | 3/1987 | Focaracci | 239/428.5 |
| 4,783,283 | 11/1988 | Stoddart | 252/547 |
| 4,789,495 | 12/1988 | Cahall et al. | 252/95 |
| 4,800,036 | 1/1989 | Rose et al. | 252/12 |
| 4,842,771 | 6/1989 | Rörig et al. | 252/547 |
| 4,992,195 | 2/1991 | Dolan et al. | 252/99 |
| 5,225,096 | 7/1993 | Ahmed et al. | 252/94 |
| 5,232,621 | 8/1993 | Dixit et al. | 252/174.23 |
| 5,252,242 | 10/1993 | Shevade et al. | 252/97 |
| 5,336,426 | 8/1994 | Rader et al. | 252/102 |
| 5,368,766 | 11/1994 | Dixit | 252/94 |
| 5,389,157 | 2/1995 | Smith | 134/22 |
| 5,395,547 | 3/1995 | Broadwell et al. | 252/97 |

*Primary Examiner*—Paul Lieberman
*Assistant Examiner*—Gregory R. Delcotto
*Attorney, Agent, or Firm*—Sharon R. Kantor

[57] ABSTRACT

The present invention concerns a thickened viscoelastic cleaning formulation comprising, in aqueous solution: (a) an active cleaning compound; and (b) a viscoelastic thickening system comprising a tetradecyldialkylamine oxide and a hydrophobic organic counterion; wherein the formulation has a viscosity of at least 500 cP at 20° C. The present invention is characterized as a means for reducing the characteristic "bleach odor" found in hypochlorite cleaning compositions of the prior art, particularly those which are volatilized upon dispensing. The compositions of the present invention may further be formulated to have utility as a hard surface cleaner, or as a drain opener.

19 Claims, 3 Drawing Sheets

COMPOSITION AND METHOD FOR DEVELOPING EXTENSIONAL VISCOSITY IN CLEANING COMPOSITIONS

BACKGROUND OF THE INVENTION

1. Field of the Invention

The present invention relates to cleaning compositions having viscoelastic rheology and, in particular, to hypochlorite compositions having a viscoelastic rheology, which compositions are formulated to have enhanced extensional viscosity.

2. Description of the Pertinent Art

Much of the prior art has addressed the problem of developing thickening systems for use in certain compositions, which may optionally contain bleaching agents, such as hard surface cleaning compositions or cleansers. Cleansers having increased viscosities are particularly beneficial for use on cleaning vertical or inclined surfaces, or in formulations designed for delivery through standing water such as clogged drain openers. The efficacy of such cleaning compositions and formulations is greatly improved by viscous compositions due, in part, to increased residence time of the cleaner. Other problems associated with nonviscous compositions, such as misting of the product and drift to unprotected surfaces, as well as undesired sputtering during application and use, can also be minimized. The latter are regarded as objectionable phenomena in response to which consumer preference for a thickened product is well documented.

In one approach for providing improved cleaning products, Hynam, et al., U.S. Pat. No. 3,684,722, teaches the thickening of hypochlorite solutions through use of an amine oxide and a fatty acid soap. U.S. Pat. No. 4,229,313, to Joy, recites cleaning compositions containing mixtures of branched and straight chain amine oxides. Neither of these references teach or suggest viscoelastic thickening systems.

Following a slightly different approach, Schlip, U.S. Pat. No. 4,337,163, recites thickened chlorine bleach compositions containing an amine oxide or a quaternary ammonium compound and a saturated fatty acid soap. Schlip's compositions achieve kinematic viscosities of from 10 to 150 centistokes (cS), but the presence of a buffer salt is required. Stoddart, U.S. Pat. No. 4,576,728, recites a thickened, shear-thinning hypochlorite composition that includes 3- or 4-chlorobenzoic acid, 4-bromobenzoic acid, 4-toluic acid and 3-nitrobenzoic acid in combination with an amine oxide. Bentham, et al., U.S. Pat. No. 4,399,050, disclose hypochlorite compositions thickened with carboxylated surfactants, amine oxides and quaternary ammonium compounds. Citrone, et al., U.S. Pat. No. 4,282,109, claim hypochlorite bleach thickened with a combination of $C_{10-18}$ amine oxide plus alkali metal $C_{8-12}$ alkyl sulfate, with a ratio of amine oxide to sulfate of at least 3:4.

Rörig, et al., U.S. Pat. No. 4,842,771 disclose a tertiary amine oxide containing at least one alkyl group of $C_{16}$ or higher in combination with cumene-, xylene- or toluene sulfonate, but also requires 1–5% of an acid such that the pH does not exceed about 6. Rörig, et al., therefore exclude the possibility of alkaline cleaners. Rose, et al., U.S. Pat. No. 4,800,036, describe viscoelastic hypochlorite solutions thickened with "onium surfactant ions" and aromatic sulfonate or carboxylate counterions, where the onium moiety is a quaternary ammonium group. Rader, et al., U.S. Pat. No. 5,336,426, and Smith, U.S. Pat. No. 5,389,157, both disclose aryl alkyl sulfonate with alkyl chain lengths of $C_{1-4}$. Stoddart, U.S. Pat. No. 4,783,283, describes a shear thinning hypochlorite composition containing 0.1% to 5% of a $C_{12-15}$ amine oxide combined with 0.05% to 0.5% of an alkylated benzene or napthalene sulfonate in which the alkyl group contains one to four carbon atoms. The disclosure of Stoddart is limited to combining an amine oxide with the two specified aryl sulfonates, and no viscoelastic behavior is exhibited. Boden, et al., U.S. Pat. No. 4,390,448, disclose a detergent system comprised of a $C_{10-20}$ alkyl diphenyloxide disulfonate and a $C_{11-13}$ dimethylamine oxide. Steinhauer, U.S. Pat. No. 4,071,463, recites thickened hypochlorite bleach compositions comprised of alkali metal $C_{6-20}$ alkyl sulfates, preferably highly branched $C_{12}$ alkyl groups, and alkaline builders.

Many thickeners of the prior art are unsuitable for use in cleaning compositions when, particularly as is contemplated herein, they are employed to thicken hypochlorite compositions. Inorganic thickeners, for example, have proven to be particularly troublesome when used in spray-type dispensers, as the thickeners frequently obstruct spray dispenser openings and therefore interfere with dispensing performance. Another problem not adequately addressed by thickened cleaning compositions of the prior art is a reduction of the characteristic and often objectionable "bleach odor" typically found in hypochlorite cleaning compositions. This bleach odor may result from the actual chlorine-releasing compounds, from molecular chlorine, or from related compounds. Even when fragrances are added, a bleach odor often persists with conventional thickened cleaning products, much to the dissatisfaction of the consumer or end user. One approach that has been taken to reduce this bleach odor is to employ certain prior art dispensers which, unfortunately, volatilize the chlorine-containing compositions and can give rise to associated unpleasant inhalation experiences. Furthermore, these dispensers are characterized by the need to apply the foam material directly from the dispenser onto the surface to be cleaned. Accordingly, these dispensers are relatively inefficient due to their inability to rapidly apply the foam material when Large surface areas are to be cleaned.

It is therefore an object of the present invention to provide viscoelastic, thickened compositions adaptable for use with hypochlorite bleaches, which compositions have a viscoelastic rheology and which are amenable to dispensing via a trigger sprayer.

It is another object of the present invention to provide a hypochlorite composition with reduced misting and bleach odor upon dispensing.

It is a further object of the present invention to provide a thickened hypochlorite cleaning composition which is phase stable under typical storage temperature conditions, as well as at elevated or low temperatures.

It is yet another object of the present invention to provide a stable thickened hypochlorite composition with a viscoelastic rheology for increased drain opening efficacy.

It is yet a further object of the present invention to provide a bleach stable viscoelastic thickening system which is effective at both high and low ionic strength.

SUMMARY OF THE INVENTION AND OBJECTS

Surprisingly, it has now been found that increased viscosities can be obtained by employing thickening formulations comprised of nonionic surfactants, in particular certain quaternary amine oxides, in combination with organic counterions. These formulations can provide exceptional viscoelastic rheological properties while simultaneously affording a technique for reducing "bleach odor" in hypochlorite-containing bleaching or cleaning compositions. The present invention therefore provides viscoelastic, thickened compositions adaptable for the delivery of hypochlorite oxidants for bleaching or cleaning applications and a method for producing the same. The inventive compositions have viscoelastic rheology and are formulated to have enhanced extensional viscosity.

The viscous cleaning compositions of the present invention provide a number of distinct advantages over prior art thickened cleaning products, among which are: the hypochlorite composition is thickened with a viscoelastic rheology; the viscoelastic thickener is chemically stable as well as thermodynamically phase stable in the presence of a variety of cleaning actives, including hypochlorite, and retains this stability over a wide temperature range (from about 1.8° C. (35° F.) to about 37.8° C. (100° F.); the viscoelastic thickeners are effective at both high and low ionic strength; the composition results in shear thinning behavior for ease of dispensing and extentional viscosity for odor reduction; and thickening is achieved with relatively low levels of surfactant, or active cleaning compound, which aids in improving chemical and physical stability of the novel cleaning formulations. These and other advantages of the present invention will become apparent to those skilled in the art upon reading the following detailed description of the invention, including the preferred embodiments, as well as the appended claims.

DEFINITIONS

Figure 1:
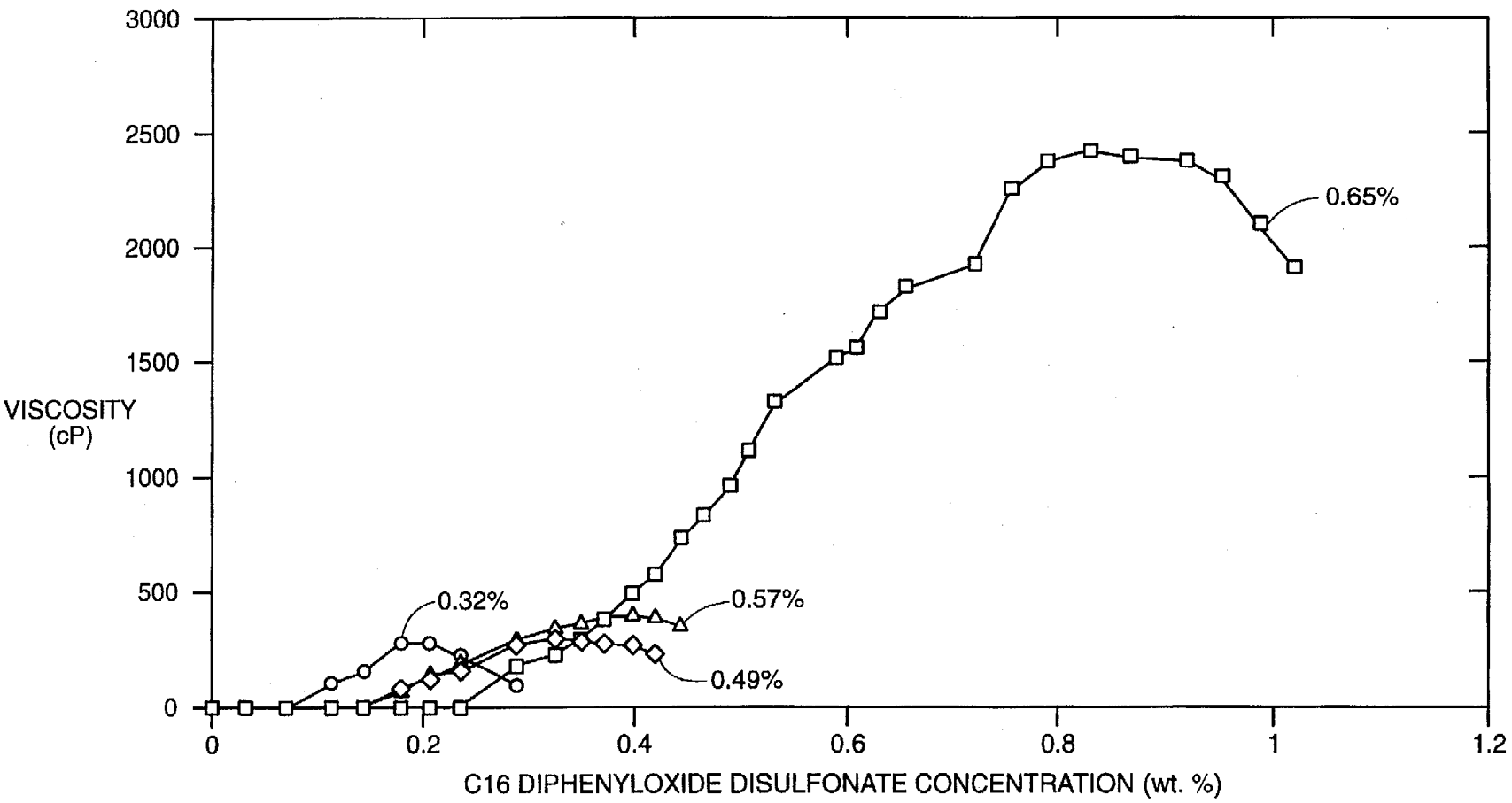
FIG. 1 is a graph of shear viscosity versus $C_{16}$ diphenyloxide disulfonate concentration for different concentrations of $C_{14}$ amine oxide to determine regions of maximum viscosity for several embodiments of the present invention.

In this document, use shall be made of the following terms of art, which have the meanings indicated below.

As used herein, the terms "Dispenser" and "Dispensing Device" refer to mechanical objects which can provide a stream or spray of a bleach composition formulated with the inventive thickening systems defined herein. Typically, a dispenser is a hand-held device. For example, the dispensing device can include a container for the bleach composition, a pump, and a spray-forming or stream-forming nozzle. The pump ejects the bleach composition from the container through the nozzle and into the atmosphere. Preferred dispensing devices have parts that are resistant to chemical attack by bleach or hypochlorite. Such dispensers can also include a suitable aerosol device that has a propellant, an atomizer, or both.

The term "extensional viscosity" describes the uniaxial resistance of a sample to flow along the stress vector in an extensional flow field. One example of extensional flow is a stretching deformation induced along one axis, which can be approximated by drawing fluid into opposing jets. In extensional flow, the velocity gradient is in the same direction as the flow. In shear flow, by contrast, the velocity gradient is perpendicular to the direction of flow. An extensional flow field is much stronger than a shear flow field, causing significant extension of flexible particles (e.g., rod-micelles) that would otherwise deform minimally in shear flow. The extension of flexible particles has a significant impact on the measured viscosity, since the friction of the particle is roughly proportional to its largest dimension. Extensional properties of a sample can be more important than shear properties in certain situations of practical importance, such as squeezing a sample through an orifice, or controlling jet break-up during spray formation.

"Micelles" as used herein are structures that form spontaneously by the self-association of individual moieties, such as surfactant molecules, in a liquid medium. These molecular aggregates are in equilibrium with monomeric or dissolved—but unassociated—surfactant molecules above a certain concentration for a given surfactant (also known as the critical micellization concentration, or CMC) in a given temperature range. "Normal" micelles are characterized by relatively hydrophobic core regions comprised of lipophilic (hydrophobic) parts of surfactants which avoid contact with water as much as possible, and outer hydrophilic regions formed by lipophobic (hydrophilic) ends of the molecules. Depending on the number of surfactant molecules in the aggregate, micellar shapes can vary from spheres to oblate or prolate ellipsoids, the latter including elongated or rod micelles as well as discs. Rod micelles are also favored, inter alia, by lengthening of alkyl chains. (See, e.g. Smith, U.S. Pat. No. 5,011,538, which is incorporated herein by reference.)

The term "Mist" as used in conjunction with aqueous liquids herein means fine liquid droplets suspended in or falling through a moving or stationary gas atmosphere. Specifically, a mist provides an undesirable drift of aqueous droplets through a gas atmosphere. In contrast to a spray, a mist is generally defined as a gas-suspended liquid particle which has a diameter of less than about 10 μm, while a spray is a gas-suspended liquid particle which has a diameter of greater than about 10 μm.

As used herein, "Shear thinning" refers to the characteristic property possessed by a liquid in which the application of a shear force to the liquid will result in an increased tendency towards flow in the liquid, and subsequently cause an apparent thinning out of the liquid in the direction of the applied force.

The term "Viscoelastic" refers to liquids that exhibit a combination of behavior characterized as both viscous, i.e. liquid-like in that energy is dissipated through the liquid, and elastic, i.e., solid-like in that energy is stored in the fluid. Viscoelastic is used herein in general association with the cleaning formulations of the present invention.

DETAILED DESCRIPTION OF THE INVENTION

It has now surprisingly been found that stable thickening systems having viscoelastic rheologies in aqueous solution may be prepared from a tertiary amine oxide nonionic surfactant, in particular a tetradecyldialkylamine oxide, and a hydrophobic counterion. The hydrophobic counterion is preferably an anionic species, such as alkyldiphenyl ether sulfonate, although compounds such as taurates, sarcosinates, salicylates, carboxylates, benzoic acid and derivatives thereof, as well as alkali metal salts of any of the foregoing, may also be used. When formulated with an active cleaning compound, the viscous compositions of the present invention exhibit remarkable shear sensitivity or shear thinning, and may be conveniently dispensed without drifting undesirably onto unprotected surfaces such as clothing, furniture, skin, eyes, etc. It is particularly surprising that the compositions are sufficiently fluid-like for expulsion from spray dispensers, yet they immediately recover their thickened character upon being sprayed, thus enabling proper adherence to the surface or surfaces to be cleaned. This seeming dichotomy is possible because of the viscoelastic behavior and shear thinning properties of the thickener systems of the present invention. This latter viscoelastic characteristic is generally referred to as rapid viscosity recovery.

The viscoelastic cleaning compositions of the present invention are thermodynamically quite stable, and exhibit good phase stability over a temperature range from about 1.8° C. (35° F.) to about 37.8° C. (100° F.). Surprisingly, the inventive viscoelastic product formulations also demonstrate a reduction in bleach odor when dispensed through a nozzle or other constrictive orifice. This odor reduction is thought to be due principally to reduced misting, which is evidenced by the fact that the inventive product formulations tend to develop larger droplets at the dispensing aperture. The formation of larger droplets upon spraying, in turn, is consistent with the increased extensional viscosity observed for the inventive thickener systems.

When the inventive thickening systems are combined with at least one active cleaning compound, the resulting inventive cleaning formulations can provide viscosities which range, for example, from 20 up to about 5,000 centipoise (cP) and even higher. These cleaning formulations simultaneously exhibit greatly enhanced thickening as well as stabilization of the composition with a concomitant reduction of bleach odor. These highly desirable characteristics may be realized where the composition is employed in a wide variety of dispensers for directing the composition as a spray, stream or otherwise onto hard surfaces to be cleaned. More specifically, as noted above, the invention particularly contemplates the use of the composition in spray-type dispensers such as the manually operated trigger-type dispensers sold, for example, by Specialty Packaging Products, Inc., or Continental Sprayers, Inc. Dispensers of these types are also disclosed, for example, in Dunning, et al., U.S. Pat. No. 4,538,745, and Focaracci, U.S. Pat. No. 4,646,973, both of which are incorporated herein by reference thereto. In the disclosed dispensers, the composition is divided into relatively fine particles which are then directed as a spray onto the surface to be cleaned. The spray dispenser is particularly desirable in its ability to uniformly apply the composition to a relatively large surface area in a convenient manner.

A first embodiment of the present invention, therefore, comprises a stable cleaning composition having a viscoelastic rheology comprising, in aqueous solution:

(a) an active cleaning compound; and (b) a viscoelastic thickening system further comprising (i) a tetradecyldialkylamine oxide, and (ii) a hydrophobic organic counterion.

In addition, a number of additional components may be added to the foregoing stable cleaning composition. The additional components function as hereinafter described and serve to improve or enhance stability, rheology, efficacy and/or aesthetics or consumer acceptance of the commercial product.

Viscoelasticity is imparted to the cleaning formulations of the present invention by a thickening system which includes a tetradecyldialkylamine oxide and a hydrophobic organic counterion. The viscosity of the resulting surfactant formulations of the present invention can range from slightly greater than that of water to several thousand centipoise (cP) at room temperature (approximately 20° C. or 68° F.). From a consumer standpoint, a preferred viscosity range is from about 20 cP to 3000 cP, more preferably from about 40 cP to 2500 cP, and most preferably from about 50 cP to 2000 cP, although the optimal viscosity range will depend upon the particular rheological properties and how shear sensitive the thickener is. For dispensing cleaning products via a trigger- or nozzle-type sprayer, for example, viscosities in the range from about 20 cP to about 1,000 cP are desirable. For a clogged drain opener, viscosities in the range of 100 cP to about 2,000 cP are especially preferred. According to one embodiment of the invention which provides a spray cleaner, the viscosity is 20 to 500 cP.

The elements required for use in the thickened cleaning formulations of the present invention are therefore a surface active cleaning compound such as a surfactant, and a viscoelastic thickening system further comprising an amine oxide and a hydrophobic counterion, each of which are discussed in greater detail below.

Active Cleaning Compound

A number of known cleaning compounds are compatible with the viscoelastic thickening systems of the present invention. Such cleaning compounds interact with their intended target materials either by chemical or enzymatic reaction or by physical interactions, all of which are hereinafter collectively referred to as reactions. Usefull reactive compounds include acids, bases, oxidants, reductants, solvents, enzymes, thioorganic compounds, surfactants or detergents, as well as mixtures of any of the foregoing. Examples of enzymes include proteases, amylases, lipases and cellulases. Usefull solvents include saturated hydrocarbons, ketones, carboxylic acid esters, terpenes, glycol ethers, and the like. Oxidants, e.g., bleaches, are a preferred active cleaning compound, and may be selected from various halogen or peroxygen bleaching compounds. Particularly preferred oxidants are halogen bleach sources which may be selected from various hypochlorite-producing species, for example, bleaches selected from the group consisting of alkali metal and alkaline earth salts of hypohalite, haloamines, haloimines, haloimides and haloamides. All of the immediately foregoing species are believed to produce hypohalous bleaching species in situ. Hypochlorite and compounds that produce hypochlorite in aqueous solution are preferred halogen bleach sources, although hypobromite is also suitable. Representative hypochlorite-producing compounds include sodium, potassium, lithium and calcium hypochlorite, chlorinated trisodium phosphate dodecahydrate, potassium and sodium dichloroisocyanurate and trichlorocyanuric acid.

Organic bleach sources suitable for use include heterocyclic N-bromo- and N-chloroimides such as trichlorocyanuric and tribromocyanuric acid; dibromo and dichlorocyanuric acid, as well as potassium and sodium salts thereof; N-brominated and N-chlorinated succinimide, malonimide, phthalimide and naphthalimide; hydantoins such as dibromo- and dichlorodimethyl hydantoin and chlorobromodimethyl hydantoin; N-halosulfamides; haloamines wherein the halide is preferably chlorine or bromine; as well as combinations of any of the above. Particularly preferred for use as the active cleaning compound in cleaning formulations of the present invention is sodium hypochlorite, which has the chemical formula NaOCl. The active cleaning compound is present in the inventive product formulations in an amount ranging from about 0.1% to about 15% by weight, more preferably about 0.1% to 10% by weight, and most preferably from about 0.2% to 6% by weight of the entire cleaning formulation.

Thickening System

The novel thickening systems of the present invention comprise an nonionic surfactant further comprising an amine oxide, and a hydrophobic counterion. These materials will now be discussed in greater detail.

a. Amine oxide

The nonionic surfactant suitable for use in this invention is an amine oxide. According to one embodiment of the invention, the amine oxide is preferably bleach-stable. In general, it is preferred to use tertiary amine oxides, especially trialkyl amine oxides, according to the following representative structure:

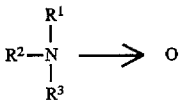

where $R^2$ represents $C_{14}$ alkyl, and $R^1$ and $R^3$ are each $C_{1-3}$, most preferably methyl. When $R^1$ and $R^3$ are both methyl and $R^2$ is alkyl averaging $C_{14}$, the structure for dimethyltetradecylamine oxide, a particularly preferred amine oxide, is obtained. Representative examples of this particular nonionic surfactant include those sold under the name AMMONYX®MO (available from Stepan Chemical Company) and BARLOX® 14–5 (available from Lonza, Inc.).

The $R^2$ group in the representative structure above is preferably a straight-chain moiety, although some degree of branching is acceptable at about the gamma carbon or further from the nitrogen atom. Generally, the more distal the carbon relative to the amine group, the longer the branched chain may be. Amine oxides having a branched $R^2$ group are thus considered to be within the scope of the present invention as long as the longest chain of the branched $R^2$ group contains no more than about 14 carbon atoms. The amine oxide is present in a thickening effective amount, which comprises about 0.1 to 5.0%, more preferably about 0.1 to 3.0%, and most preferably from about 0.2 to 1.5% by weight of the total cleaning formulation of the present invention.

A key consideration in the present invention concerns the chain length of the amine oxide $R^2$ group. It is important that the amine oxide contain a relatively high percentage of $R^2$ as $C^{14}$ tetradecylalkyl groups, which may be contrasted with the amine oxides described and claimed in U.S. Pat. No. 5,462,689 to Choy, et al. (of common assignment herewith and incorporated by reference thereto), which recited and claimed thickening systems based on alkyl groups averaging 16 carbon atoms. Aside from those instances in which $R^2$ consists virtually exclusively of $C_{14}$ alkyl chain groups, mixtures of alkyl groups containing shorter (e.g. $C_{10-12}$) and longer (e.g. $C_{15-18}$) chain lengths may also be used, provided that the average alkyl group length is $C_{14}$. However, mixed chain lengths can result in the formation of mixed micelles, thus mitigating or destroying the extensional viscosities of the inventive thickening systems. For example, amine oxides containing alkyl chain lengths much shorter than about $C_{14}$ tend to be hydrophilic and rather soluble in aqueous solution. These shorter chain alkyl groups in combination with the counterion therefore result in mixtures that do not exhibit large extensional properties, and subsequently exhibit poor viscoelastic thickening characteristics. On the other hand, it is also of concern that $R^2$ alkyl groups with chain lengths much longer than about $C_{16-18}$ (or those with even more carbon atoms) tend to be increasingly hydrophobic with chain length and are therefore not readily soluble in the aqueous systems. Mixtures of amine oxides containing $R^2$ groups with alkyl chains longer than $C_{15}$, therefore, in combination with a suitable counterion as described below, do not tend to impart thickening characteristics in forming viscoelastic mixtures.

In terms of a desirable $C_{14}$ chain length content of the product formulations of the present invention, the foregoing discussions may be conceptually summarized by reference to the following equations:

$$A_{CF} \times [Am.O.] = F_{C\text{-}14} \qquad \text{Equation (1)}$$

where:

$A_{CF}$ is the actual amount of $C_{14}$ present in the final product formulation (expressed in weight percent (wt. %));

[Am.O.] is the concentration of the amine oxide in the final product formulation in wt. %; and $F_{C\text{-}14}$, the fraction of amine oxide $R^2$ groups that are $C_{14}$ alkyl, is further defined according to:

$$F_{C\text{-}14} = (R^2 \text{ as } C_{14}) \div (R^2_{total}) \qquad \text{Equation (2)}$$

where:

($R^2$ as $C_{14}$) represents the amount of amine oxide for which $R^2$ is $C_{14}$ alkyl; and ($R^2_{total}$) represents the total amount of amine oxide in the composition.

Acceptable values for the term $A_{CF}$ according to the present invention are from about 0.1 to 5.0%, more preferably about 0.1 to 3.0%, and most preferably from about 0.2 to 1.5%. These values are consistent with those previously provided for the amine oxide thickening effective amount. Equation (I) above may be more easily understood through use of an example. Consider a situation in which the only amine oxide $R^2$ alkyl groups present are $C_{12}$ and $C_{14}$, and further that these groups are present in a ratio of 1:2 for $C_{12}$:$C_{14}$. The quantity ($R^2$ as $C_{14}$) would have a value of 2, ($R^2_{total}$) would be 3, and $F_{C\text{-}14}$ would have a value of ⅔. If sufficient amine oxide were used such that the amine oxide concentration in the final product formulation was about 3.0 wt. %, $A_{CF}$ would have a final value of 2.0 wt. %, characteristic of a moderately thick, viscoelastic liquid according to Table I below.

TABLE I

TYPICAL VALUES FOR $A_{CF}$ AND CORRESPONDING CHARACTERISTICS OF VISCOELASTIC THICKENED PRODUCTS ACCORDING TO THE PRESENT INVENTION

| Value for $A_{CF}$ (wt. %) | Viscoelastic Thickened Product Characterization |
|---|---|
| 0.1–0.6 | Somewhat viscoelastic liquid; Viscosity from approx. 10 to 500 cP |
| 0.6–1.2 | Moderately thick viscoelastic liquid; Viscosity from approx. 500 to 1,000 cP |
| 1.0–2.0 | Very thick viscoelastic liquid; Viscosity from approx. 1,000 to 3,000 cP |
| 2.0–5.0 | Extremely thick viscoelastic liquid, bordering on gel-like character, especially at higher end of range; Viscosity approx. >3,000 cP |

In addition to the foregoing criteria, it is desirable, although not absolutely essential, that the shorter (i.e. $C_{10-12}$ or fewer carbons) chain length fraction in a $C_{14}$-containing mixture of $R^2$-amine oxides be less than 40%, more preferably less than 25%, and most preferably less than 10% of the total number of amine oxide $R^2$ groups present. It is also preferable that the fraction of longer (i.e. $C_{16-18}$ or more carbons) chain length $R^2$ groups in an amine oxide mixture be less than 20%, more preferably less than 15%, and most preferably less than about 10% of the total number of $R^2$ groups present. At the same time, it is preferable that the $R^2$ group of the amine oxide comprise at least 60%, more preferably at least 70% and most preferably at least 80% of the total number of $R^2$ groups present as $C_{14}$. In one embodiment of the present invention, AMMONYX®MO is the preferred amine oxide.

b. Organic Counterion

It has surprisingly been found that viscoelastic thickening systems as defined herein are most successfully obtained when the counterion is a sufficiently hydrophobic species. Such hydrophobic species have been found to be the most effective at promoting micelle formation, structures whose presence characterizes many of the preferred viscoelastic thickened systems of the present invention. Accordingly, organic counterions suitable for use with the present invention may be selected from the group consisting of alkyl aryl ether sulfonate surfactants which include alkylated diphenyloxide sulfonates of the general structure:

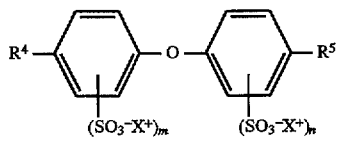

where $R^4$ and $R^5$ may be H, alkyl averaging 5 to 20 carbon atoms in length, or one of each; X is H or an alkali metal selected from the group consisting of Na, K or Li, or a combination thereof; and m and n may independently have values of 0 or 1. When X is H, an acidic diphenyloxide sulfonate counterion is obtained, and a nonionic counterion is obtained when X is an alkali metal. According to one preferred embodiment of the present invention, when $R^4$ is alkyl, $R^5$ is H. When n and m are each=1, the structure for a disulfonate, a particularly preferred sulfonate, is obtained. According to another embodiment of the invention, X is preferably H. Diphenyloxide disulfonates used according to the present invention tend to impart rather good clarity and are therefore preferred for use in the inventive thickening systems. Monosulfonates, on the other hand, in which the total value for m and n=1 (i.e., m+n=1), tend to exhibit poor clarity characteristics, and are therefore not particularly preferred.

The alkyl group chain length of the counterion appears to be a key factor in the thickening systems of the present invention. While mixtures of alkyl group chain lengths are possible for $R^4$, thus giving rise to disubstituted phenyloxide counterions, mixed chain lengths can result in the formation of mixed micelles, and thus negatively impact viscosities of the inventive thickening systems. For this reason, monoalkyl-substituted phenyloxide sulfonates are generally preferred over dialkyl-substituted phenyloxide sulfonates.

Surprisingly, it has now been found that thickening systems with desirable rheological properties may conveniently be obtained by combining the inventive amine oxides described above with diphenyl oxide sulfonate surfactants, particularly when the alkyl group chain length is on the order of sixteen carbon atoms ($C_{16}$). The use of $C_{16}$ alkyl diphenyloxide disulfonates provides a unique combination for generating improved viscoelastic thickening, as well as providing an additional surfactant for improved cleaning performance. Diphenyloxide sulfonates with alkyl chain lengths on the order of $C_{18}$ or greater exhibited significantly decreased aqueous solubility, thus rendering marginal the contribution of such species to thickening properties of the inventive viscoelastic systems. When the alkyl chain lengths of the counterion were shorter, for instance on the order of $C_6$ to $C_{12}$, large extensional properties were not observed in combination with the inventive amine oxides described above, probably due to the increased aqueous solubilities of these shorter chain length species.

For the foregoing reasons, it is preferred that the combined fraction for shorter chain lengths (i.e. $C_{6-14}$ or fewer carbons) and longer chain lengths (i.e. $C_{18}$ or more carbons) in a mixture of counterions be less than 20%, more preferably less than 15%, and most preferably less than about 10% by weight of the total weight of counterion alkyl groups present. It is also preferable that the counterion alkyl group comprise at least 85%, more preferably at least 95% and most preferably at least 99% by weight of the total weight of $R^4$ or $R^5$ groups present. In one embodiment of the present invention, the counterion may be selected from among the DOWFAX® series of surfactants (available from Dow Chemical), especially the monoalkyldiphenyloxide sulfonates (or "MADS"), as well as POLY-TERGENT®4C3 (Olin Chemical). DOWFAX®8390, designated as a $C_{16}$-MADS type surfactant, is one counterion which is suitable for use in the present invention. Other DOWFAX®$C_{16}$ MADS type counterions may also be suitable for use.

The hydrophobic counterion is present in a thickening effective amount, which generally comprises from about 0.1% to 4.0%, more preferably about 0.1% to 3.0%, and most preferably about 0.2% to 1.5% by weight of the total cleaning product formulation of the present invention. The preferred weight ratio of amine oxide to counterion which may be used in the inventive viscoelastic thickening compositions according to the present invention is between 10:1 and 1:10, preferably 4:1 to 1:2 and more preferably from 2:1 to 1:1. According to one embodiment of the invention, the ratio is about 4:3. The ratio deperidence indicates that the structure of the mixed micelle is the determining factor in obtaining extensional properties. Without being bound by any particular theory, Applicants believe that the counterion promotes the formation of elongated rod-like micelles with the amine oxide. These micelles can form a network which results in efficient thickening. It has thus surprisingly been found that the viscoelastic thickening as defined herein is most successfully obtained when the counterion is a sufficiently hydrophobic species. Such species are probably more effective at facilitating micelle formation.

Cosurfactants

In certain instances, it may be especially desirable to use a viscoelastic cleaning preparation which exhibits a reduced tendency to seize up or freeze at lower application or storage temperatures. In this context, temperatures in the range of approximately 0° C. (32° F.) to about 20° C. (68° F.) are contemplated. Applicants have now determined that thickening can be enhanced, and have surprisingly learned that lower temperature phase stability can be improved, through the addition of a cosurfactant selected from the group consisting of quaternary ammonium compounds, betaines, sarcosinates, taurides, and mixtures thereof. Amine oxides having R groups other than $C_{14}$ may also be used, provided that the rod micelle formation is not adversely affected. Additionally, non-thickening cosurfactants can be added for other purposes as desired, such as, but not necessarily limited to, detergency, solubilization, wetting, etc.

The foregoing cosurfactants may be added in an amount effective to accomplish the desired function of improved low temperature viscoelasticity, and may generally be added in a weight percentage range of 0.0% to about 5.0%, and more preferably from about 0.1% to about 2.0% of the total weight of the viscoelastic formulations of the present invention. According to one preferred embodiment of the present invention, a suitable cosurfactant may be chosen from the $C_{16}$-amine oxide/xylene sulfonate counterion mixtures described and claimed in U.S. Pat. No. 5,462,689 described above.

PH Adjusting Agent/Buffer

Where desirable, pH adjusting agents may be added to the viscoelastic cleaning formulations of the present invention in order to achieve a certain pH. Buffers, on the other hand, may assist in maintaining the pH once a desired pH level has been established. In the present invention, alkaline pH ranges (i.e. pH values greater than about 7.0) are generally favored for purposes of both rheology and for maintaining hypochlorite stability.

Examples of buffers which are suitable for use with the present invention include the alkali metal phosphates, polyphosphates, pyrophosphates, triphosphates, tetraphosphates, silicates, metasilicates, polysilicates, carbonates, hydroxides, and mixtures of the same. Where the active cleaning compound is an oxidant, particularly a halogen bleach source, control of the pH level may be necessary to retain stability of the halogen source. To avoid protonating the amine oxide, the pH should be maintained above the $pK_a$ of the amine oxide. Where the amine oxide is tetradecyldimethylamine oxide, for example, the pH should be above about 7.0. Where the active halogen source is sodium hypochlorite, the pH is maintained above about pH 10.5, preferably above about pH 12. According to a preferred embodiment, the pH is about 13.5. Most preferred for adjusting the pH of the viscoelastic thickening formulations of the present invention are the alkali metal hydroxides, especially sodium hydroxide. The total amount of a pH adjusting agent or buffer, which includes any amount inherently present with a bleach and any separately included, can vary from about 0% to 5%, preferably from about 0.1–1.0% by weight.

Electrolyte

An electrolyte may be added to the novel viscoelastic thickening systems of the present invention in order to promote viscosity development. The purpose for adding electrolytes, on the one hand, is to provide an ion source, e.g. cations, where anionic surfactants are present in aqueous solution. Without being bound by theory, Applicants believe that an aqueous ionic solution provides a charged medium in which surfactant molecules can interact, thus promoting the formation of molecular surfactant micellar aggregates which give rise to the observed theological properties of the invention.

Certain compounds may function in the present invention as both buffer and electrolyte. These particular buffers or electrolytes are generally the alkali metal salts of various inorganic acids, such as: alkali metal salts of phosphates polyphosphates, pyrophosphates, triphosphates, tetraphosphates, silicates, metasilicates, polysilicates, carbonates, hydroxides, and mixtures thereof. Certain divalent salts, e.g. alkaline earth salts of phosphates, carbonates, hydroxides, etc., can also function singly as buffers. If such compounds are used, they would be combined with at least one of the previously mentioned electrolytes or buffers in order to provide the appropriate pH adjustment.

Inorganic salts such as alkali metal chlorides and sulfates, as well as relatively bleach-stable organic alkali metal salts of gluconates, succinates and maleates, may also be utilized as electrolytes to maintain the ionic strength for the desired rheology. It may be noted that where sodium hypochlorite is the active cleaning compound, sodium chloride is typically present as a by-product of the hypochlorite formation, and additional electrolyte is generally unnecessary.

An especially preferred electrolyte/buffer for use with the viscoelastic cleaning formulations of the present invention is alkali metal silicate. The preferred silicate is sodium silicate, which has the empirical formula $Na_2O:SiO_2$. The ratio of sodium oxide to silicon dioxide is about 1:4 to 2:1, more preferably about 1:2. Silicates are available from numerous sources, such as PQ Corporation. The amount of deliberately added electrolyte can vary from about 0% to 10.0%, and preferably from about 0.1% to 5% of the weight of the total formulation.

Adjuncts

The viscoelastic thickening systems of the present invention can be formulated to include such components as fragrances, coloring agents, whiteners, solvents, chelating agents and builders to enhance performance, stability or aesthetic appeal of the composition. From about 0.01% to about 0.5% of a fragrance, such as those commercially available from International Flavors and Fragrance, Inc., may be included in any of the embodiments of the invention. Dyes and pigments may also be included in small amounts. Two examples of widely used pigments which may be incorporated into the compositions of the present invention include ultramarine blue (UMB) and copper phthalocyanines. Suitable builders which may be optionally included comprise carbonates, phosphates and pyrophosphates. As is known in the art, such builders function to reduce the concentration of free calcium or magnesium ions in the aqueous solution. Certain of the previously mentioned buffer materials, e.g. carbonates, phosphates, phosphonates, polyacrylates and pyrophosphates, may also function as builders.

Drain Opening Actives

A drain opening active according to the present invention is an acid, base, solvent, oxidant, reductant, enzyme, surfactant, thioorganic compound, or mixture thereof, which is suitable for use in opening drains. It is understood herein that the concept of "opening a drain" embodies the cleaning out or removal of congestion, obstructions or other forms of buildup which may commonly be found to clog sink drains. In general, clog-removal materials may act by any one of the following methods: chemically reacting with the clog material to fragment it or render it more water-soluble or dispersible; physically interact with the clog material by, e.g. adsorption, absorption, solvation, or healing (i.e. to melt grease); or by enzymatically catalyzing a reaction to fragment or render the clog more water-soluble or dispersible, etc. Particularly suitable drain opening active materials are alkali metal hydroxides and hypochlorites. Combinations of the foregoing are also suitable. The drain opener may also contain various adjuncts known in the art, including corrosion inhibitors, dyes and fragrances.

A second embodiment of the present invention, therefore, is a drain opening formulation which includes:

(a) a viscoelastic thickener comprising a tetradecyldialkylamine oxide and a hydrophobic organic counterion;
(b) an alkali metal hydroxide;
(c) optionally an alkali metal silicate;
(d) optionally an alkali metal carbonate; and
(e) a drain opening active.

Component (a) comprises the inventive viscoelastic thickening system as described previously. The alkali metal hydroxide is preferably potassium or sodium hydroxide, and is present in an amount of between about 0.5% and 20%. The preferred alkali metal silicate is one having the formula $M_2O(SiO)p$ where M is an alkali metal and p has a value between 0.5 and 4. When M is sodium, p is preferably 2.3.

The alkali metal silicate may be present in an amount of about 0% to 5.0%. The preferred alkali metal carbonate is sodium carbonate, which is preferably present in amounts of between about 0% and 5.0%. About 1% to 10% by weight of a cleaning active is present, with values in the range of about 4% to 8% more preferred. Sodium chloride or other similar salts may be added as a densifying agent, i.e., a substance which imparts a density greater than that of water to a particular composition, thus aiding in the penetration or flow of the composition through standing water.

The formation of rod-like micelles is expected whenever packing geometrical considerations may allow. That is, if the repulsive forces between surfactant head groups can be reduced, such as those due to steric constraints or electrostatic factors such as ionic charge, then larger rod-like micelles can be formed. This can occur even at the same concentrations which would typically only form normal spherical micelles.

Rod-like micelles result in extensional viscosity based upon extensional flow. The extensional flow, as it occurs in the nozzle of a sprayer, is uniaxial and in essence stretches the molecules passing through it. If the molecules are long but naturally coiled, as in rod micelles, the extensional flow will literally straighten the molecules out, causing them to occupy much more volume than in a normal three-dimensional flow field. Because of the constricted movement and the resulting loss of volume to move about, the (extensional) viscosity goes up by factors of 10 to 1,000-fold. The excess viscosity forms larger drops at the nozzle, such that the flow field remains cohesive, thus minimizing mist formation. The larger drops will also settle down faster by gravity, again minimizing contact with the bleach solution.

The inventive thickened formulations may also have utility as hard surface cleaners. The thick solutions are clear and transparent, and can have higher viscosities than hypochlorite solutions of the prior art. Because viscoelastic thickening is more efficient, less surfactant is needed to attain higher viscosity, and chemical and physical stabilities of the compositions are generally better. Less surfactant also results in a more cost-effective composition. As a hard surface cleaner, the viscoelastic rheology prevents the composition from spreading onto horizontal sources and thus aids in protecting nearby bleach-sensitive surfaces. The viscoelasticity also provides the benefits of a thick system, e.g. increased residence time on non-horizontal surfaces. On non-horizontal surfaces, the composition flows off at a much slower rate, leaving behind a film which can promote rather effective cleaning.

Advantageously, the thickening systems of the present invention are not diminished by the further increase of ionic strength for thickening, nor do they require the addition of electrolyte for thickening. The viscoelastic compositions of the present invention are phase-stable and retain their rheology in solutions with more than about 0.5 weight percent ionizable salt, e.g. sodium chloride and sodium hypochlorite, corresponding to an ionic strength of about 0.09 g-ions/Kg solution. It is expected that the viscoelastic rheology would remain intact even at ionic strengths of at least about 6 g-ions/Kg. The surfactant system also does not significantly degrade hypochlorite, even after prolonged (over two years) storage. Compositions ranging from 0.5 wt. % to 1.45 wt. % total surfactant did not remit in appreciable loss of hypochlorite.

Experimental

As defined above, a viscoelastic liquid is one that possesses both elastic or solid-like properties and viscous-like behavior. Solutions prepared from $C_{12}$ or $C_{14}$ amine oxides generally exhibit very little viscoelastic behavior, as demonstrated by a frequency sweep in the linear viscoelastic region with a Bohlin VOR Rheometer. Surprisingly, however, the inventive combination of $C_{14}$ amine oxides with $C_{16}$ alkylaryldiphenyloxide sulfonates described herein give rise to unique systems with large viscoelastic responses and relaxation times far in excess of those outlined in the prior art. For example, viscosities above 500 cP at 5 rpm shear rate on a Brookfield RVTDV-II Viscometer were measured at about 20° C. (68° F.) when $C_{14}$ amine oxide (0.65% by weight) and $C_{16}$ diphenyloxide disulfonate (0.51% by weight) were added to LIQUID PLUMR® (The Clorox Company), a presently-existing drain opener product.

A series of diphenyloxide sulfonates were evaluated in order to elucidate which alkyl group chain length would lead to optimal viscoelastic thickening properties. Again, 0.65% amine oxide was used in combination with different diphenyloxide sulfonate concentrations. The results of this study are summarized in the data shown in Table II below. For each example given in the Table, the amine oxide contained at least 85% or better $C_{14}$ alkyl groups, and the diphenyloxide sulfonate contained at least 85% alkyl groups as $C_{16}$ (see, i.e., Sample No. 1 in Table II below). When the concentration of the active $C_{16}$ alkyl groups increased, the thickness of the mixtures increased, reaching viscosities over 1,000 cP to values approaching 2,500 cP at a concentration of 95% active $C_{16}$ diphenyloxide sulfonate alkyl group (Sample Nos. 2 and 3 in Table II below).

TABLE II

THICKENING AS A FUNCTION OF DIPHENYLOXIDE SULFONATE CHAIN LENGTH FOR DRAIN OPENER FORMULATIONS[a] CONTAINING 0.65% $C_{14}$ AMINE OXIDE AT 20° C.

| Sample No. | Concentration of Diphenyloxide Sulfonate Alkyl Group[b] Chain Length[c] | Type[d] | Concentration of Diphenyloxide Sulfonate at Maximum Viscosity (%) | Maximum Viscosity (cP) | Clarity |
|---|---|---|---|---|---|
| 1 | 85% $C_{16}$ | MADS | 0.51 | 585 | Good |
| 2 | 95% $C_{16}$ | MADS | 0.84 | 2,400 | Good |
| 3 | 90% $C_{16}$ | MADS | 0.45[e] | 1,175 | Good |
| 4 | 95% $C_{16}$ | MAMS | — | 1 | Poor |
| 5 | 95% $C_{16}$ | DADS | — | 1 | Poor |
| 6 | 95% $C_{12}$ | MADS | 0.29 | 80 | Good |
| 7 | 95% $C_{12}$ | MAMS | — | 1 | Poor |
| 8 | 95% $C_{12}$ | DADS | — | 1 | Poor |
| 9 | 85% Branched $C_{12}$ | MADS | — | 1 | Poor |
| 10 | 85% $C_{10}$ | MADS | — | 1 | Good |
| 11 | 95% $C_{10}$ | MAMS | — | 1 | Poor |
| 12 | 95% $C_{10}$ | DADS | — | 1 | Poor |
| 13 | 95% $C_6$ | MAMS | — | 1 | Poor |

Notes to Table II

[a]Typical drain opener formulations used contained the following: sodium hypochlorite, 5.8%; sodium hydroxide, 1.75%; sodium chloride, 4.5%; sodium silicate, 0.11%; balance, water.

[b]Alkyl groups were linear unless indicated otherwise.

[c]Balance comprised of other alkyl group chain length(s).

[d]The types of diphenyloxide sulfonate used corresponded to the following:
MADS = monoalkyl, diphenyloxide disulfonate
MAMS = monoalkyl, diphenyloxide monosulfonate
DADS = dialkyl, diphenyloxide disulfonate

[e]This sample may contain 5% MAMS contamination.

Figure 2:
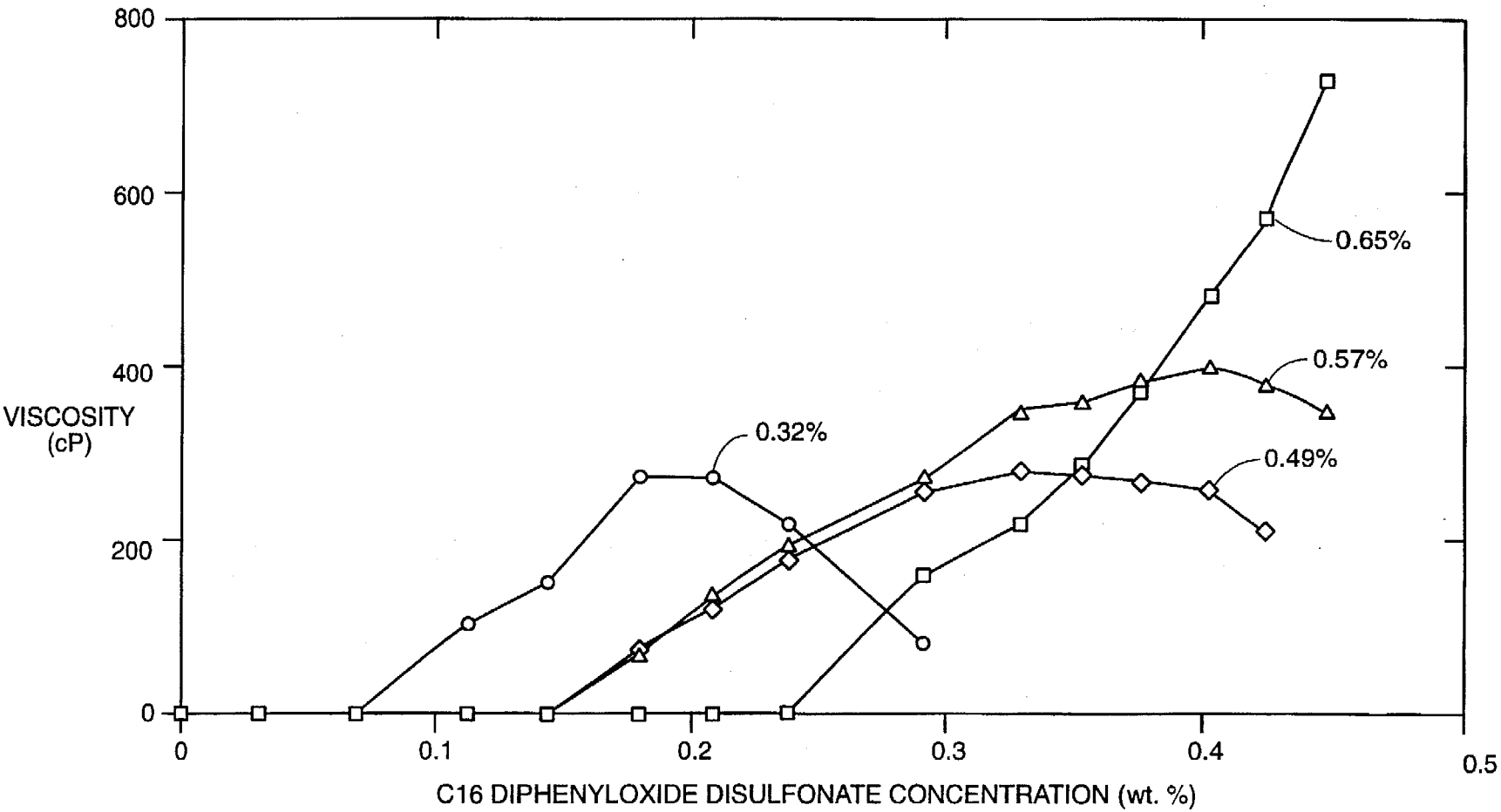
FIG. 2 is an enlarged scale rendering of the graph in FIG. 1 for the $C_{16}$ concentration region between 0.0% and 0.5% by weight.
Figure 3:
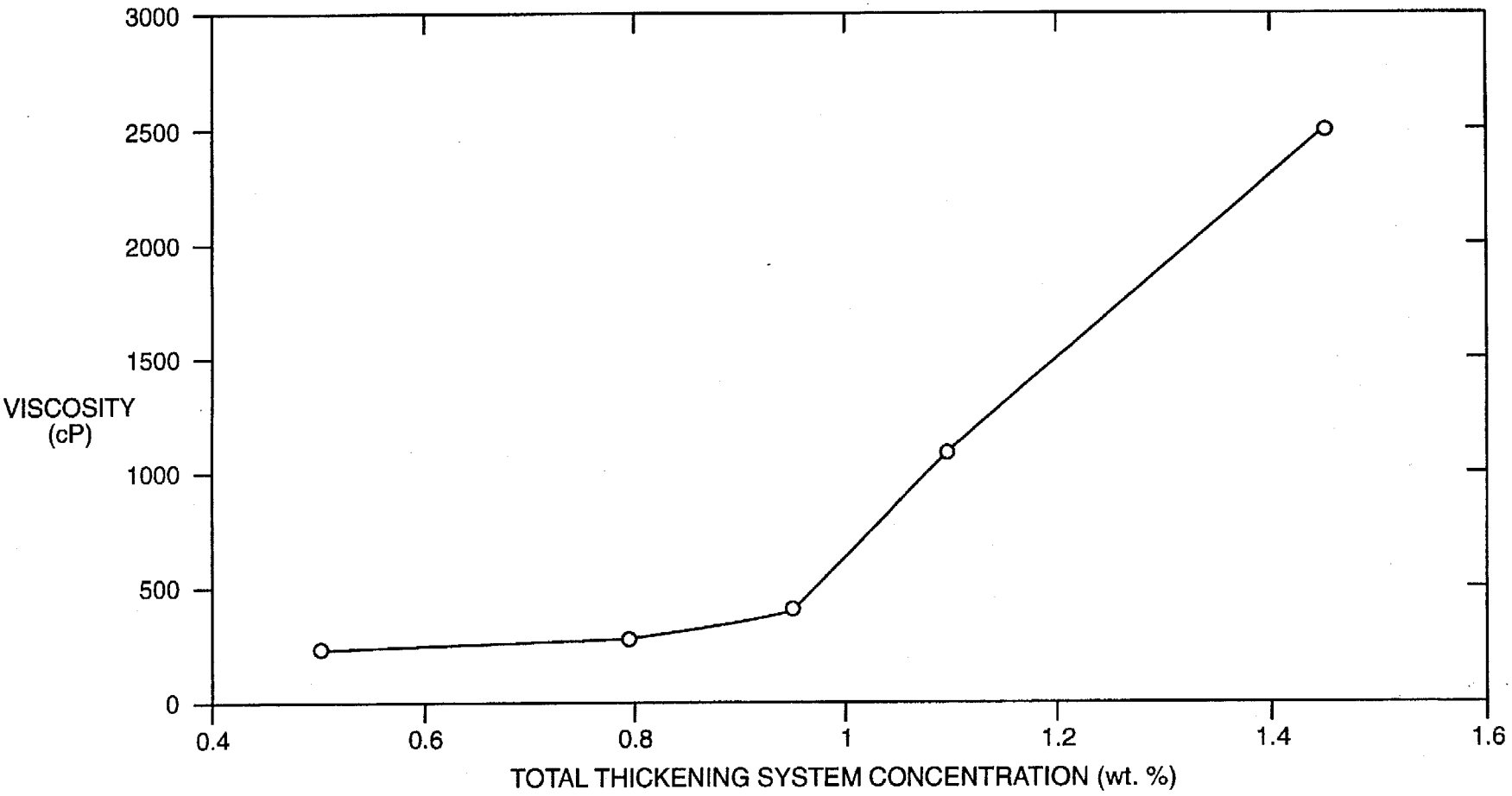
FIG. 3 is a graph of viscosity as a function of total thickener system (e.g. $C_{14}$ amine oxide/$C_{16}$ diphenyloxide sulfonate) concentration for various product formulations according to several embodiments of the invention.

Another phenomenon that has been observed with the viscoelastic thickening systems of the present invention is the dependence of the ratio of $C_{14}$ amine oxide to $C_{16}$ diphenyloxide sulfonate in order to achieve maximum viscosity. That is, as the amount of $C_{14}$ amine oxide increases, the amount of $C_{16}$ diphenyloxide disulfonate needed to achieve maximum viscosity increases disproportionately. This phenomenon is demonstrated in Table III below, as well as in FIGS. 1 and 2. FIG. 3 shows a graph of viscosity as a function of the total surfactant concentration for the compositions according to Table III below.

TABLE III

CHANGE IN CONCENTRATION OF $C_{14}$ AMINE OXIDE VERSUS $C_{16}$ DIPHENYLOXIDE DISULFONATE TO ACHIEVE MAXIMUM VISCOSITY OF DRAIN OPENER FORMULATIONS[a] AT 20° C.

| | A | B | C | D |
|---|---|---|---|---|
| [$C_{14}$ amine oxide] at maximum viscosity | 0.32% | 0.49% | 0.57% | 0.65% |
| [$C_{16}$ diphenyloxide disulfonate] at maximum viscosity | 0.18% | 0.32% | 0.40% | 0.80% |
| Total surfactant concentration | 0.50% | 0.81% | 0.97% | 1.45% |
| Ratio of $C_{14}$ amine oxide to $C_{16}$ diphenyloxide disulfonate at maximum thickening[b] | 1.77 | 1.55 | 1.43 | 0.81 |
| Maximum viscosity (cP) | 272 | 278 | 400 | 2,400 |

Notes to Table III

[a]Typical drain opener formulations used contained the following: sodium hypochlorite, 5.8%; sodium hydroxide, 1.75%; sodium chloride, 4.5%; sodium silicate, 0.11%; balance, water.

[b]Calculated values for ratio of $C_{14}$ amine oxide to $C_{16}$ diphenyloxide disulfonate at maximum thickening may not agree to values reported due to rounding off of numbers.

The foregoing disclosure and Examples reveal that stable viscoelastic thickening systems may be prepared for use by combining $C_{14}$ amine oxides with $C_{16}$ diphenyloxide disulfonates. Furthermore, the inventive thickening systems may be formulated with various cleaning compositions to give novel thickened cleaning formulations.

Although specific components and proportions have been used in the above description of the preferred embodiments of the novel viscoelastic thickening systems, other suitable materials and minor variations in the systems as given herein may be used. In addition, other materials may be added to those used herein, and variations may be made in the thickened systems and viscoelastic formulations to improve upon, enhance or otherwise modify the properties of or increase the uses for the invention.

It will be understood that various other changes of the details, materials, steps, arrangements of components and uses which have been described herein and illustrated in order to explain the nature of the invention will occur to and may be made by those skilled in the art upon a reading of this disclosure, and such changes are intended to be included within the principle and scope of this invention. The invention is further defined without limitation of scope or of equivalents by the claims which follow.

What is claimed is:

1. A viscoelastic thickening system for thickening liquid aqueous cleaning compositions, the viscoelastic thickening system comprising:

(a) an amine oxide according to the following representative structure:

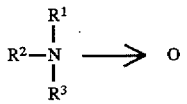

wherein $R^1$ and $R^3$ are each $C_{1-3}$, $R^2$ is alkyl averaging $C_{14}$, and at least 60% of the total $R^2$ groups are present as $C_{14}$; and (b) a hydrophobic $C_{10-16}$ mono- or di-alkyl substituted organic counterion having an alkyl chain length distribution of at least 80% $C_{16}$, the counterion selected from among taurates, sarcosinates, salicylates, carboxylates, benzoic acids, diphenylether mono- or di-sulfonates, and mixtures of any of the foregoing;

wherein the ratio of amine oxide to counterion is from 10:1 to 1:10 and the viscoelastic thickening system is characterized as a micelle formation.

2. The viscoelastic thickening system of claim 1 wherein the viscosity is at least 20 cP at 20° C. and the organic counterion is a diphenylether mono- or di-sulfonate.

3. The viscoelastic thickening system of claim 1 wherein the viscosity is at least 500 cP at 20° C. and the liquid cleaning composition comprises a hypochlorite cleaning active.

4. A viscoelastic thickening system for thickening a liquid aqueous cleaning composition for use in a spray dispenser to deliver the composition onto a hard surface to be cleaned, the viscoelastic thickening system comprising:

(a) about 0.1 to 5.0 weight percent of an amine oxide according to the following representative structure:

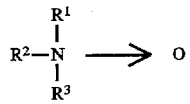

wherein $R^1$ and $R^3$ are each $C_{1-3}$, $R^2$ is alkyl averaging $C_{14}$, and at least 60% of the total $R^2$ groups are present as $C_{14}$; and (b) about 0.1 to 4.0 weight percent of a hydrophobic mono- or di-alkyl substituted organic counterion having an alky chain length distribution of at least 80% $C_{16}$, the counterion selected from among taurates, sarcosinates, salicylates, carboxylates, benzoic acids, diphenylether mono- or di-sulfonates, and mixtures of any of the foregoing;

in an amount effective for thickening a liquid cleaning composition when the composition is dispensed onto a surface to be cleaned and further for maintaining stability of the composition, the composition having a viscosity of at least about 20 cP at 20° C., and further wherein the composition is characterized as a micelle formation.

5. The viscoelastic thickening system of claim 4 wherein the counterion is an alkali metal diphenylether disulfonate, the micelle formation is a rod micelle formation, and the ratio of amine oxide to counterion is from 10:1 to 1:10.

6. The viscoelastic thickening system of claim 4 further including a pH adjusting agent.

7. The viscoelastic thickening system of claim 4 wherein the pH is above 7.0.

8. The viscoelastic thickening system of claim 4 wherein the viscosity is from about 20 to 3,000 cP for achieving optimum atomization of the cleaning composition in a spray-type dispenser.

9. A method for preparing a viscoelastic thickened aqueous cleaning composition for use on a hard surface, comprising the step of:

(a) combining a viscoelastic thickening system with an aqueous hard surface cleaning composition, the viscoelastic thickening system comprising:

(i) an amine oxide according to the following representative structure:

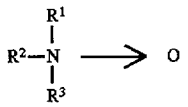

wherein $R^1$ and $R^3$ are each $C_{1-3}$, $R^2$ is alkyl averaging $C_{14}$, and at least 60% of the total $R^2$ groups are present as $C_{14}$; and (ii) a hydrophobic $C_{10-16}$ mono- or di-alkyl substituted organic counterion having an alkyl chain length distribution of at least 80% $C_{16}$, the counterion selected from among taurates, sarcosinates, salicylates, carboxylates, benzoic acids, diphenylether mono- or di-sulfonates, and mixtures of any of the foregoing;

wherein the ratio of amine oxide to counterion is from 10:1 to 1:10 and the viscoelastic thickening system is characterized as a micelle formation and has a viscosity of at least about 20 cP at 20° C.

10. The method of claim 9, wherein the thickening system further includes a pH adjusting agent in an mount effective for adjusting the pH of the cleaning composition to greater than about 10.5.

11. The method of claim 9, wherein the cleaning composition has a viscosity of at least about 500 cP and a pH of at least 7.0 at 20° C.

12. In a cleaning composition containing about 0.1% to about 10% by weight of an alkali metal hypochlorite intended to be dispensed via a spray dispenser tending to divide the composition into particles and resulting in the release of bleach odor, a method for preparing a viscoelastic thickened aqueous cleaning composition, comprising the step of:

(a) combining a viscoelastic thickening system with an aqueous cleaning composition, the viscoelastic thickening system comprising:

(i) about 0.1 to 5.0 weight percent of an amine oxide according to the following representative structure:

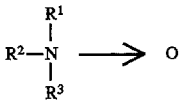

wherein $R^1$ and $R^3$ are each $C_{1-3}$, $R^2$ is alkyl averaging $C_{14}$, and at least 60% of the total $R^2$ groups are present as $C_{14}$; and (ii) about 0.1 to 4.0 weight percent of a hydrophobic mono- or di-alkyl substituted organic counterion having an alkyl chain length distribution of at least 80% $C_{16}$, the counterion selected from the group consisting of diphenylether mono- or di-sulfonates;

based on the total weight of the visccelastic thickened aqueous cleaning composition; wherein the thickening cleaning composition is characterized by a rod micelle formation, has a viscosity from about 20 cP to about 5,000 cP at 20° C., reduces bleach odor when the composition is dispensed onto a surface to be cleaned and maintains the stability of the composition.

13. The method of claim 12, wherein the composition has a viscosity from about 20 to about 1,000 cP.

14. The method of claim 12, further comprising the step of (b) adding a hypochlorite bleach stable fragrance to the cleaning composition, the reduction of bleach odor achieved in the composition also resulting in an enhanced odor of the fragrance.

15. The method of claim 12, further comprising the step of (c) adding a pH adjusting agent to the cleaning composition in an amount effective for adjusting the pH to greater than about 10.5.

16. A viscoelastic thickening system for thickening an aqueous liquid drain opening composition containing about 1% to about 10% by weight of a drain opening active, the viscoelastic thickening system comprising:

(a) about 0.1 to 5.0 weight percent of an amine oxide according to the following representative structure:

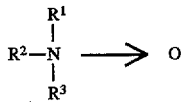

wherein $R^1$ and $R^3$ are each $C^{1-3}$, $R^2$ is alkyl averaging $C_{14}$, and at least 60% of the total $R^2$ groups are present as $C_{14}$; and (b) about 0.1 to 4.0 weight percent of a hydrophobic mono- or di-$C_{10-16}$ substituted organic counterion having a chain length distribution of at least 80% $C_{16}$, the counterion selected from the group consisting of diphenylether mono-or di-sulfonates:

wherein the thickened drain opening composition has a viscosity greater than about 20 cP at 20° C., a density greater than that of water, and is characterized by a rod micelle formation.

17. The viscoelastic thickening system of claim 16, wherein the sulfonate is a mono-$C_{10-16}$ substituted diphenylether mono- or di-sulfonate.

18. The viscoelastic thickening system of claim 16, wherein the diphenylether sulfonate is a diphenylether di-sulfonate and the drain opening active is a hypochlorite drain opening active.

19. The viscoelastic thickening system of claim 16, wherein the composition further comprises:

(c) 0.5 to 20 weight percent of an alkali metal hydroxide;

(d) 0 to 5 weight percent of an alkali metal silicate; and (e) 0 to 5 weight percent of an alkali metal carbonate.

* * * * *